US006194373B1

(12) United States Patent
Saito et al.

(10) Patent No.: US 6,194,373 B1
(45) Date of Patent: Feb. 27, 2001

(54) LIQUID DETERGENT COMPOSITION

(75) Inventors: Makoto Saito; Tohru Yamamoto, both of Kanagawa; Nobuyoshi Nambu; Masanori Furukawa, both of Mie, all of (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 09/347,451

(22) Filed: Jul. 6, 1999

Related U.S. Application Data

(60) Provisional application No. 60/136,226, filed on May 26, 1999.

(30) Foreign Application Priority Data

Jul. 3, 1998 (JP) ..... 10-188723

(51) Int. Cl.[7] ..... C11D 3/33; C11D 3/60; C11D 17/00; C11D 17/08

(52) U.S. Cl. ..... 510/405; 510/337; 510/340; 510/533

(58) Field of Search ..... 510/337, 405, 510/340, 499, 531, 533

(56) References Cited

U.S. PATENT DOCUMENTS 3,914,185 10/1975 Inamorato .
3,953,380 * 4/1976 Sundby ..... 252/543
4,020,016 4/1977 Sokol .
5,186,856 2/1993 Holland .
5,536,452 7/1996 Black .

FOREIGN PATENT DOCUMENTS 0 511 091 A1 10/1992 (EP) .
0 513 948 A2 11/1992 (EP) .
2 003 173 3/1979 (GB) .
2 193 505 2/1988 (GB) .

OTHER PUBLICATIONS

Martell and Calvin, Chemistry of the Metal Chelate Compounds, Prentice Hall, Inc., 1962, pp. 42, 157–158, 1962.*
JP 63 051500 A, Abstract XP002076232, *Database WPI*, Section Ch, Week 8815.

* cited by examiner

*Primary Examiner*—Yogendra Gupta
*Assistant Examiner*—John M Petruncio
(74) *Attorney, Agent, or Firm*—Sughrue, Mion, Zinn, Macpeak & Seas, PLLC

(57) ABSTRACT

A high-concentration liquid detergent composition, which does not have strong alkalinity, which has excellent compatibility even if the surfactant concentration is increased, and which is free of white turbidity, comprising (A) one or more surfactants selected from a nonionic surfactant and an anionic surfactant, (B) one or more builders selected from an amine salt and an alkali metal-amine mixed salt of aminopolycarboxylic acid chelating agent, and (C) one or more solubilizing agents selected from alcohols, with component (A) being present in a concentration of 20 wt % or more.

11 Claims, No Drawings

LIQUID DETERGENT COMPOSITION

CROSS REFERENCE TO RELATED APPLICATIONS

This application is an application filed under 35 U.S.C. §111(a) claiming benefit pursuant to 35 U.S.C. §119(e)(i) of the filing date of Provisional Application No. 60/136,226 filed May 26, 1999 pursuant to 35 U.S.C. §111(b).

FIELD OF THE INVENTION

The present invention relates to a liquid detergent composition comprising a surfactant and an aminopolycarboxylic acid-based organic builder. More specifically, the present invention relates to a high concentration liquid detergent composition having excellent compatibility with a surfactant, superior resistance against white turbidity and good biodegradability.

BACKGROUND OF THE INVENTION

In liquid detergents, particularly in liquid detergents used as a house detergent, a nonionic surfactant and/or an anionic surfactant are used as the surfactant and a builder of various types is added to increase detergency. Various types of organic or inorganic builders can be used but almost all builders have a Na salt structure.

In recent years, from the standpoint of environmental conservation, studies are aggressively being made on the use of an aminopolycarboxylic acid having excellent biodegradability, particularly an amino acid diacetic acid-type chelating agent, as the builder. Aminopolycarboxylic acids including amino acid diacetic acid chelating agents are used in the form of a synthetic reaction solution as it is on account of the cost. Therefore, in almost all cases, these are Na salts which assume strong alkalinity. For example, JP-A-10-25494 (the term "JP-A" as used herein means an "unexamined published Japanese patent application") discloses a liquid detergent for dishes, comprising an aspartic acid diacetic acid builder, where an alkali metal salt is used. JP-A-10-36888 discloses a liquid detergent comprising an aminopolycarboxylic acid builder, where an amine salt is disclosed on the same level with an alkali metal salt and in Examples, a Na salt is used. Moreover, the maximum concentration of the surfactant in this composition is as low as 10 wt %, thus, the problem of white turbidity on the high concentration side is not solved.

The use of a builder has a problem in that the solubility or clouding point of the surfactant as the main agent decreases and thereby the compatibility is deteriorated to cause, for example, white turbidity or separation of the white turbidity into two layers with the elapse of time. In order to prevent these, a technique of diluting the liquid detergent composition with water to reduce the concentration of the surfactant or a technique of adding a solubilizing agent has been heretofore used. However, the former case of diluting the liquid detergent composition with water inevitably results in an increase in the cost of transporting the detergent and this is commercially disadvantageous. In the latter case, it is known to newly add a surfactant as a solubilizing agent or add a urea, an ether alcohol or a lower alcohol. However, the effect is not sufficiently high for obtaining a high concentration liquid detergent composition.

SUMMARY OF THE INVENTION

An object of the present invention is to obtain a liquid detergent which has excellent biodegradability, which does not assume strong alkalinity, which has excellent compatibility even if the surfactant concentration is increased, and which is free of white turbidity.

As a result of extensive investigations to solve the above-described problems, the present inventors have found that in where a nonionic surfactant and/or anionic surfactant is used at a high concentration as the main surfactant of a liquid detergent and an aminopolycarboxylic acid chelating agent is used as a builder, by using an amine salt or an alkali metal-amine mixed salt as the counter ion of the builder and at the same time, adding an alcohol thereto, the compatibility is increased and the white turbidity can be prevented. The present invention has been accomplished based on this finding.

The present invention relates to the liquid detergent composition described below.

In one embodiment, the invention provides a liquid detergent composition comprising:

(A) one or more surfactants selected from the group consisting of a nonionic surfactant and an anionic surfactant, (B) one or more builders selected from the group consisting of an amine salt and an alkali metal-amine mixed salt of an aminopolycarboxylic acid chelating agent, and (C) one or more solubilizing agents selected from the group consisting of alcohols, with component (A) being present in a concentration of 20 wt % or more.

In another embodiment, the invention provides a liquid detergent composition comprising:

(A) from 20 to 60 wt % of one or more surfactants selected from the group consisting of a nonionic surfactant and an anionic surfactant, (B) from 0.1 to 15 wt % of one or more builders selected from the group consisting of an amine salt and an alkali metal-amine mixed salt of aminopolycarboxylic acid chelating agent, (C) from 0.5 to 30 wt % of one or more solubilizing agents selected from the group consisting of alcohols, and (D) the balance of water.

A further embodiment comprises a liquid detergent composition as described in (1) or (2), wherein the aminopolycarboxylic acid is an amino acid-N,N-diacetic acid.

An even further embodiment is a liquid detergent composition as described in (1) or (2), wherein the aminopolycarboxylic acid is glutamic acid-N,N-diacetic acid, α-alanine-N,N-diacetic acid, β-alanine-N,N-diacetic acid, aspartic acid-N,N-diacetic acid, glycine-N,N-diacetic acid or serine-N,N-diacetic acid.

Additionally, another embodiment is a liquid detergent composition as described in any one of (1) to (4), wherein the alcohol is a glycol.

DESCRIPTION OF THE PREFERRED EMBODIMENTS

The surfactant used as component (A) in the present invention is one or more selected from a nonionic surfactant and an anionic surfactant. Among these, a nonionic surfactant has a higher solubility than an anionic surfactant, accordingly, it is suitable for preparing a high concentration liquid detergent composition. The surfactant is used at a concentration of 20 wt % or more in the liquid detergent composition.

Examples of suitable nonionic surfactants include polyoxyethylene alkyl ether, polyoxyethylene alkyl phenyl ether, fatty acid diethanolamide, amine oxide and amidoamine oxide. Examples of appropriate anionic surfactants include alkyl sulfate, alkylpolyoxyethylene sulfate, alkylbenzenesulfonate, α-olefinsulfonate, fatty acid salts, ether carboxylates and monoalkylphosphates. A number of these may be commercially available.

The aminopolycarboxylic acid-based chelating agent used in the builder as component (B) of the present invention is a chelating agent containing one or more, preferably one or two amino groups and two or more, preferably three or four carboxyl groups, and having a chelating action. The amino group may be a secondary amino group or a tertiary amino group. The chelating agent is preferably an amino acid-N, N-diacetic acid.

An amino acid-N,N-diacetic acid is a compound represented by the following formula (1)

$$A\text{-}N\text{-}(CH_2COOH)_2 \quad (1)$$

wherein $A\text{-}NH_2$ represents an amino acid, and —N represents an amino group in the amino acid.

Examples of amino acid-N,N-diacetic acids include glutamic acid-N,N-diacetic acid, α-alanine-N,N-diacetic acid, β-alanine-N,N-diacetic acid, aspartic acid-N,N-diacetic acid, glycine-N,N-diacetic acid and serine-N,N-diacetic acid. These amino acid-N,N-diacetic acids may be synthesized by a known Strecker reaction using, for example, an amino acid as the raw material or may be synthesized from a monochloroacetic acid.

Other than the amino acid-N,N-diacetic acid, examples of aminopolycarboxylic acid chelating agents include ethylenediaminedisuccinic acid and iminodisuccinic acid. These may also be synthesized by a known method and used. Examples of preferred aminopolycarboxylic acid chelating agents are shown below by their structural formulae.

Glutamic acid-N, N-diacetic acid

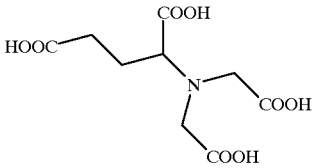

α-Alanine-N, N-diacetic acid

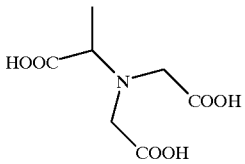

Aspartic acid-N, N-diacetic acid

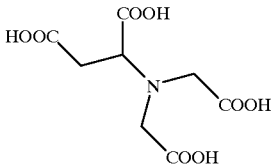

-continued

β-Alanine-N, N-diacetic acid

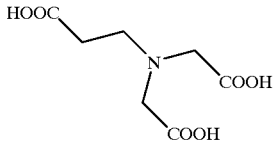

Glycine-N, N-diacetic acid

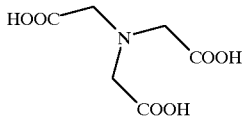

Ethylenediaminedisuccinic acid

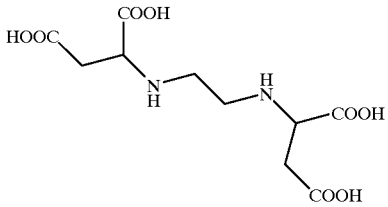

Iminodisuccinic acid

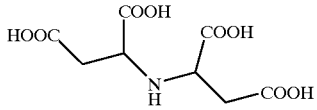

Serine-N, N-diacetic acid

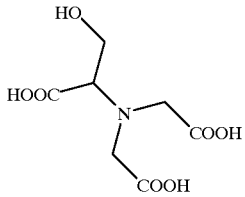

On account of the cost, amino acid-N,N-diacetic acids and other aminopolycarboxylic acid-based chelating agents are generally obtained as an aqueous solution where all carboxyl groups have an Na salt as the counter ion. However, in the present invention, the aminopolycarboxylic acid for use in the builder as component (B) is used in the form of an amine salt or an alkali metal-amine mixed salt. The effect may be obtained using primary, secondary and tertiary amines, however, the amine salt used is preferably an alkanolamine salt, more preferably triethanolamine salt or diethanolamine salt. The alkali metal salt in the alkali metal-amine mixed salt is preferably a K salt because it has a higher compatibility with the surfactant than an Na salt, however, in view of the cost, a Na salt is more preferred.

In order to convert the aminopolycarboxylic acid chelating agent obtained in the form of a Na salt into an alkali metal-amine mixed salt, the Na salt aqueous solution obtained may be treated to remove Na using an H-type cation exchange resin or by electrodialysis, or may be subjected to acid deposition to obtain a crystal having an H type carboxyl group. Thereafter, the resulting solution as it is or in the case of a crystal, a solution obtained by dissolving the crystals in water, is mixed with a mixture of an alkali metal hydroxide such as potassium hydroxide or sodium hydroxide with an amine and thereby an aqueous solution of the objective salt can be obtained. Also, after the removal of Na, the solution or crystal may be added to the formulation of a liquid detergent and then an amine or another alkali metal hydroxide may be added thereto so as to obtain the objective salt.

An aminopolycarboxylic acid-based chelating agent, particularly the aminodiacetic acid-type chelating agent is known to exert a good chelate effect, namely a builder effect, on the neutral to weakly alkali side at a pH of from 8 to 12. Therefore, the amount of the amine or alkali metal hydroxide added is preferably controlled so that the above-described pH region can be created. The larger the amount of the amine salt is, the higher the compatibility with the surfactant is, however, the ratio in the mixed salt of alkali metal and amine is necessary to be determined taking account of the cost for the removal of Na or the cost of amine.

The alcohol used as the solubilizing agent in the present invention is not particularly limited. However, a primary, secondary or tertiary alcohol, preferably a primary or secondary alcohol, having from 1 to 5 carbon atoms, preferably from 2 to 4 carbon atoms is preferred. The alcohol may be a general alcohol such as ethanol and isopropyl alcohol, however, since these are volatile and highly inflammable, a commonly used and inexpensive glycol such as propylene glycol and ethylene glycol is preferably used.

The liquid detergent composition of the present invention preferably has a composition ratio such that the surfactant as component (A) is from 20 to 60 wt %, preferably from 30 to 50 wt %, the builder as component (B) is from 0.1 to 15 wt %, preferably from 1 to 10 wt %, the solubilizing agent as component (C) is from 0.5 to 30 wt %, preferably from 1 to 20 wt %, and the balance is water as component (D). This composition ratio is the proportion among four components (A) to (D). The ratio of builder as component (B) based on the surfactant as component (A) is preferably from 2 to 20 wt %, more preferably from 5 to 15 wt %, and the solubilizing agent as component (C) based on the surfactant as component (A) is preferably from 5 to 40 wt %, more preferably from 10 to 30 wt %.

If the ratio of the surfactant as component (A) is less than the above-described range, the cost for transportation or packaging of the liquid detergent increases and this is commercially disadvantageous. If it exceeds the range, the desired compatibility can be attained only within narrow limits. As a result, flexibility in the formulation may decrease or the viscosity may increase and the handleability is disadvantageously impaired.

If the ratio of the builder as component (B) is less than the above-described range, the cleaning effect of the liquid detergent composition decreases, whereas if it exceeds the range, the compatibility with the surfactant occurs only within narrow limits and flexibility in formulation disadvantageously decreases.

If the ratio of the solubilizing agent as the component (C) is less than the above-descried range, compatibility between components (A) and (B) is reduced, whereas if it exceeds the range, flexibility in formulation disadvantageously decreases.

The liquid detergent composition of the present invention may contain, if desired, other additives in any optional ratio, such as a viscosity controlling agent, a moisture retaining agent, an antiseptic, an antifungal, a dye and a perfume.

The detergent composition of the present invention may be used for all uses as a detergent. However, this is suitably used in particular as a home detergent for cleaning clothes or household materials.

The detergent composition of the present invention may be used as it is or may be used after diluting it with water because the concentration is high.

According to the present invention, a builder comprising an amine salt or amine-alkali metal mixed salt of an aminopolycarboxylic acid and a solubilizing agent comprising an alcohol are mixed each in a specific ratio with a specific surfactant, therefore, a high-concentration liquid detergent composition which does not have strong alkalinity, which has excellent compatibility even if the surfactant concentration is increased, and which is free of white turbidity can be obtained.

EXAMPLES

The present invention is described below by referring to the Examples. In the Examples, "%" is "% by weight (wt %)".

Examples 1 to 16 and Comparative Examples 1 to 18:

The following surfactant, builder and solubilizing agent comprising an alcohol were added at the ratio shown in Tables 1 and 2, and the balance was water. The resulting solutions each was thoroughly mixed and left standing at an ordinary temperature or 40° C. Then, compatibility was visually observed. Those underwent separation into two layers after standing each was again mixed when observing and the solution state was observed. The formulations and visual results are shown together in Tables 1 and 2 below.

The following compounds were used.

Surfactant:

Nonionic surfactant:
EMULGEN 108, produced by Kao Corporation (trademark, ethylene oxide alkyl ether nonionic)

Anionic surfactant:
LAS, reagent, sodium linear alkylbenzenesulfonate (free of sodium sulfate)

Builder:

GLDA: glutamic acid-N,N-diacetic acid

αAD: α-alanine-N,N-diacetic acid

βPAD: β-alanine-N,N-diacetic acid

SDA: serine-N,N-diacetic acid

ASDA: aspartic acid-N,N-diacetic acid

NTA: glycine-N,N-diacetic acid

EDDS: ethylenediaminedisuccininc acid

IDS: iminodisuccininic acid

Amine:

TEA: triethanolamine

DEA: diethanolamine

MEA: monoethanolamine

Solubilizing Agent:

PG: propylene glycol

IPA: isopropyl alcohol

In Tables 1 and 2, "−2Na2TEA" after "GLDA" indicates the counter ion of the carboxyl group within the molecule and means a mixed salt of 2Na and 2TEA. "−2Na2H" means 2Na salt in the low pH state. In either case, the concentration is the value calculated when the carboxyl group is the Na salt.

TABLE 1

| Example | Surfactant | Builder | Solubilizing Agent | Compatibility |
|---|---|---|---|---|
| 1 | EMULGEN 108<br>40% | GLDA-2Na2TEA<br>5% | PG<br>12.5% | ordinary temperature: clear<br>40° C.: clear |
| 2 | EMULGEN 108<br>40% | GLDA-2Na2TEA<br>5% | PG<br>6.9% | ordinary temperature: clear<br>40° C.: clear |
| 3 | EMULGEN 108<br>40% | GLDA-1Na3TEA<br>5% | PG<br>4.8% | ordinary temperature: clear<br>40° C.: clear |
| 4 | EMULGEN 108<br>40% | GLDA-2Na2DEA<br>5% | PG<br>6.7% | ordinary temperature: clear<br>40° C.: clear |
| 5 | EMULGEN 108<br>40% | GLDA-1Na3DEA<br>5% | PG<br>4.7% | ordinary temperature: clear<br>40° C.: clear |
| 6 | EMULGEN 108<br>40% | GLDA-1Na3DEA<br>5% | IPA<br>4.7% | ordinary temperature: clear<br>40° C.: clear |
| 7 | EMULGEN 108<br>40% | GLDA-1Na3MEA<br>5% | PG<br>5.0% | ordinary temperature: clear<br>40° C.: clear |
| 8 | EMULGEN 108<br>40% | GLDA-4TEA<br>5% | PG<br>5.0% | ordinary temperature: clear<br>40° C.: clear |
| 9 | EMULGEN 108<br>40% | αAD-1Na2TEA<br>3% | PG<br>10.0% | ordinary temperature: clear<br>40° C.: clear |
| 10 | EMULGEN 108<br>40% | βAD-1Na2TEA<br>3% | PG<br>11.2% | ordinary temperature: clear<br>40° C.: clear |
| 11 | EMULGEN 108<br>40% | SDA-1Na2TEA<br>5% | PG<br>5.0% | ordinary temperature: clear<br>40° C.: clear |
| 12 | EMULGEN 108<br>40% | ASDA-1Na3TEA<br>3% | PG<br>12.1% | ordinary temperature: clear<br>40° C.: clear |
| 13 | EMULGEN 108<br>40% | NTA-1Na2TEA<br>3% | PG<br>10.9% | ordinary temperature: clear<br>40° C.: clear |
| 14 | EMULGEN 108<br>40% | EDDS-2Na2TEA<br>2% | PG<br>13.0% | ordinary temperature: clear<br>40° C.: clear |
| 15 | EMULGEN 108<br>40% | IDS-2Na2TEA<br>3% | PG<br>12.0% | ordinary temperature: clear<br>40° C.: clear |
| 16 | EMULGEN 108<br>40%<br>LAS<br>5% | GLDA-1Na3TEA<br>3% | PG<br>12.0% | ordinary temperature: clear<br>40° C.: clear |

TABLE 2

| Comparative Example | Surfactant | Builder | Solubilizing Agent | Compatibility |
|---|---|---|---|---|
| 1 | EMULGEN 108<br>40% | — | — | ordinary temperature: clear<br>40° C.: clear |
| 2 | EMULGEN 108<br>40% | GLDA-4Na<br>5% | — | ordinary temperature: white turbidity<br>40° C.: white turbidity |
| 3 | EMULGEN 108<br>40% | GLDA-4Na<br>5% | IPA<br>12.5% | ordinary temperature: white turbidity<br>40° C.: white turbidity |
| 4 | EMULGEN 108<br>40% | GLDA-4Na<br>5% | PG<br>12.5% | ordinary temperature: white turbidity<br>40° C.: white turbidity |
| 5 | EMULGEN 108<br>40% | GLDA-2Na2H<br>5% | — | ordinary temperature: white turbidity<br>40° C.: white turbidity |
| 6 | EMULGEN 108<br>40% | GLDA-2Na2MEA<br>5% | — | ordinary temperature: white turbidity<br>40° C.: white turbidity |
| 7 | EMULGEN 108<br>40% | GLDA-2Na2H<br>5% | IPA<br>12.5% | ordinary temperature: white turbidity<br>40° C.: white turbidity |
| 8 | EMULGEN 108<br>40% | GLDA-2Na2TEA<br>5% | — | ordinary temperature: white turbidity<br>40° C.: white turbidity |
| 9 | EMULGEN 108<br>40% | GLDA-4Na<br>5% | PG<br>20.7% | ordinary temperature: white turbidity<br>40° C.: white turbidity |
| 10 | EMULGEN 108<br>40% | GLDA-2Na2TEA<br>5% | TEA<br>15.1% | ordinary temperature: white turbidity<br>40° C.: white turbidity |
| 11 | EMULGEN 108<br>40% | GLDA-1Na3TEA<br>5% | — | ordinary temperature: white turbidity<br>40° C.: white turbidity |
| 12 | EMULGEN 108<br>40% | αAD-3Na<br>3% | — | ordinary temperature: white turbidity<br>40° C.: white turbidity |
| 13 | EMULGEN 108<br>40% | βAD-3Na<br>3% | — | ordinary temperature: white turbidity<br>40° C.: white turbidity |
| 14 | EMULGEN 108<br>40% | SDA-3Na<br>5% | — | ordinary temperature: white turbidity<br>40° C.: white turbidity |
| 15 | EMULGEN 108<br>40% | ASDA-4Na<br>3% | — | ordinary temperature: white turbidity<br>40° C.: white turbidity |

TABLE 2-continued

| Comparative Example | Surfactant | Builder | Solubilizing Agent | Compatibility |
|---|---|---|---|---|
| 16 | EMULGEN 108 40% | NTA-3Na 3% | — | ordinary temperature: white turbidity 40° C.: white turbidity |
| 17 | EMULGEN 108 40% | IDS-4Na 3% | — | ordinary temperature: white turbidity 40° C.: white turbidity |
| 18 | EMULGEN 108 40% LAS 5% | GLDA-4Na 3% | PG 12.0% | ordinary temperature: white turbidity 40° C.: white turbidity |

It is seen from the results in Tables 1 and 2 that, when Example 1 was compared with Comparative Examples 3, 4, 7, 8 and 10, the composition using an amine salt or an alkali metal-amine mixed salt as the builder and using an alcohol as the solubilizing agent had compatibility, whereas in the compositions using a Na salt as the builder, using no solubilizing agent or using alkanolamine as the solubilizing agent, the compatibility was poor and white turbidity occurred.

The same can be seen from a comparison between Example 3 and Comparative Example 11, Example 7 and Comparative Example 6, Example 9 and Comparative Example 12, Example 10 and Comparative Example 13, Example 11 and Comparative Example 14, Example 15 and Comparative Example 17, and Example 16 and Comparative Example 18.

As verified in the foregoing, by mixing an amine salt or alkali metal-amine mixed salt of an aminopolycarboxylic acid as the builder and an alcohol as the solubilizing agent each in a specific amount with a high-concentration nonionic or anionic surfactant, a high-concentration liquid detergent composition having excellent compatibility and free of white turbidity can be obtained.

While the invention has been described in detail and with reference to specific embodiments thereof, it will be apparent to one skilled in the art that various changes and modifications can be made therein without departing from the spirit and scope thereof.

What is claimed is:

1. A liquid detergent composition free of white turbidity comprising:

(A) from 20 to 60 wt % of one or more surfactants selected from the group consisting of a nonionic surfactant and an anionic surfactant, (B) from 0.1 to 15 wt % of one or more builders selected from the group consisting of a primary amine salt, a secondary amine salt, a tertiary amine salt an alkali metal-a primary amine mixed salt, an alkali metal-a secondary amine mixed salt, and an alkali metal-a tertiary amine mixed salt of an amino acid-N,N-diacetic acid-based chelating agent, (C) from 0.5 to 30 wt % of one or more solubilizing agents selected from the group consisting of alcohols, and (D) the balance water.

2. The liquid detergent composition free of white turbidity as claimed in claim 2, wherein the amino acid-N,N-diacetic acid is glutamic acid-N,N-diacetic acid, α-alanine-N,N-diacetic acid, β-alanine-N,N-diacetic acid, aspartic acid-N, N-diacetic acid, glycine-N,N-diacetic acid or serine-N,N-diacetic acid.

3. The liquid detergent composition free of white turbidity as claimed in claim 2, wherein the amino acid-N,N-diacetic acid is glutamic acid-N,N-diacetic acid.

4. The liquid detergent composition free of white turbidity as claimed in claim 1, wherein the alcohol is a glycol.

5. The liquid detergent composition free of white turbidity as claimed in claim 2, wherein the alcohol is a glycol.

6. A liquid detergent composition free of white turbidity comprising:

(A) from 20 to 60 wt % of one or more surfactants selected from the group consisting of a nonionic surfactant and an anionic surfactant, (B) from 0.1 to 15 wt % of one or more builders selected from the group consisting of an alkanolamine salt or an alkali metal-alkanolamine mixed salt of an amino acid-N,N-diacetic acid based chelating agent, (C) from 0.5 to 30 wt % of one or more solubilizing agents selected from the group consisting of alcohols, and (D) the balance water.

7. The liquid detergent composition free of white turbidity as claimed in claim 6, wherein the amino acid-N,N-diacetic acid is glutamic acid-N,N-diacetic acid, α-alanine-N,N-diacetic acid, β-alanine-N,N-diacetic acid, aspartic acid-N, N-diacetic acid, glycine-N,N-diacetic acid or serine-N,N-diacetic acid.

8. The liquid detergent composition free of white turbidity as claimed in claim 7, wherein the amino acid-N,N-diacetic acid is glutamic acid-N,N-diacetic acid.

9. The liquid detergent composition free of white turbidity as claimed in claim 6, wherein the alkanolamine is a monoalkanolamine, a dialkanolamine or a trialkanolamine.

10. The liquid detergent composition free of white turbidity as claimed in claim 6, wherein the alkanolamine is monoethanolamine, diethanolamine or triethanolamine.

11. The liquid detergent composition free of white turbidity as claimed in claim 6, wherein the alcohol is a glycol.

* * * * *